United States Patent [19]

Brien

[11] Patent Number: 4,705,407

[45] Date of Patent: Nov. 10, 1987

[54] PORTABLE TIME PIECE WITH LIGHT DIFFUSER

[76] Inventor: André Brien, 1390, boulevard de la Concorde - Apt 2, Laval-des-Rapides, Quebec, Canada, H7N 5P5

[21] Appl. No.: 930,541

[22] Filed: Nov. 14, 1986

[51] Int. Cl.[4] ..... G04B 19/30

[52] U.S. Cl. ..... 368/227; 368/67

[58] Field of Search ..... 368/227, 67

[56] References Cited

U.S. PATENT DOCUMENTS 4,250,575 2/1981 Flumm ..... 368/227

FOREIGN PATENT DOCUMENTS 343922 2/1960 Switzerland ..... 368/67

2052114 1/1981 United Kingdom ..... 368/227

2135083 8/1984 United Kingdom ..... 368/227

*Primary Examiner*—Bernard Roskoski

[57] ABSTRACT

A portable time piece having a casing for supporting a watch movement therein. A dial face is also disposed in said housing with a time indicator visible from a top side of the dial face whereby to display time. The time piece is characterized by a light diffusing member located above the dial face and extending in a predetermined circumferential area thereof. At least one light source is associated with the light diffusing member so that light is transmitted along and out of the member to illuminate at least the portion of the dial face, and radiate light outwardly of the top side of the casing. A light source within the casing supplies electrical power to the light source.

12 Claims, 5 Drawing Figures

PORTABLE TIME PIECE WITH LIGHT DIFFUSER

BACKGROUND OF THE INVENTION

1. Field of the Invention

The present invention relates to a time piece, and more particularly to a portable time piece such as a wristwatch, pocket watch, or the like, and wherein there is provided a light diffusing member in a circumferential portion above the dial face whereby to illuminate the dial face and radiate light outwardly of the face.

2. Description of Prior Art

It is known to provide wristwatches with illuminescent paint in certain areas of the dial face thereof whereby time may be displayed in a dark area. It is also known to mount a lamp in a glass ring located under a dial disc as disclosed in British Patent No. 271,377. However, such a ring cannot be adapted to existing watches and the thickness of the watch casing must be enlarged, such a ring also provides faint illuminence only in the peripheral edge of the dial disc and is not intended to reflect light outside the dial face to illuminate external objects. It is also difficult to replace the lamp as it is necessary to remove the movement and dial face for access thereto. It is also known to utilize light sources in alarm clocks or clock radios of the non-portable type to illuminate the dial face. A non-portable time clock is one that is not intended to be continuously carried on the person.

SUMMARY OF THE INVENTION

It is a feature of the present invention to provide a portable time piece having a light diffusing member located above the dial face and extending in a predetermined circumferential area thereof, and wherein a light source is associated with the diffuser member to illuminate the dial face.

Another feature of the present invention is to provide a portable time piece as above described, and wherein a switch is provided on the casing of the time piece to actuate the light source to illuminate the dial face and radiate light outwardly thereof to illuminate objects much like a pencil-like flashflight.

Another feature of the present invention is to provide a portable time piece having a light diffusing ring member having an outwardly angulated wall disposed inwardly of the dial face to illuminate the dial face and to direct light rays outwardly of the dial face.

Another feature of the present invention is to provide a portable time piece having a light diffusing ring with an outwardly angulated wall and at least one light source associated with the ring and wherein at least one light source is actuated by a switch associated with the casing of the time piece whereby light is directed outwardly of the dial face to illuminate objects placed in front of the time piece, much like a miniature flashlight.

Another feature of the present invention is to provide a portable time piece having a light diffusing ring and at least one light source associated with the ring and wherein the light source is easily changeable by removing the back cover, and wherein the light diffusing ring and lamp are easily adaptable to existing portable time piece constructions, and substantially inexpensive.

According to the above features, from a broad aspect, the present invention provides a portable time piece having a casing for supporting a time movement therein. A dial face having time indicating means is located in the housing and disposed for visual access from a top side of the housing to display time. The time piece is characterized by a light diffusing member located above the dial face, and extending in a predetermined circumferential area thereof. At least one light source is associated with the light diffusing member so that light is transmitted along and out of the member to illuminate at least a portion of said dial face. The light diffusing member also has a sloped wall to radiate light outwardly of the dial face. Electrical circuit means provides electrical power to the light source.

BRIEF DESCRIPTION OF DRAWINGS

A preferred embodiment of the present invention will now be described with reference to the examples thereof as illustrated in the accompanying drawings, in which.

DESCRIPTION OF PREFERRED EMBODIMENTS

Figure 1:
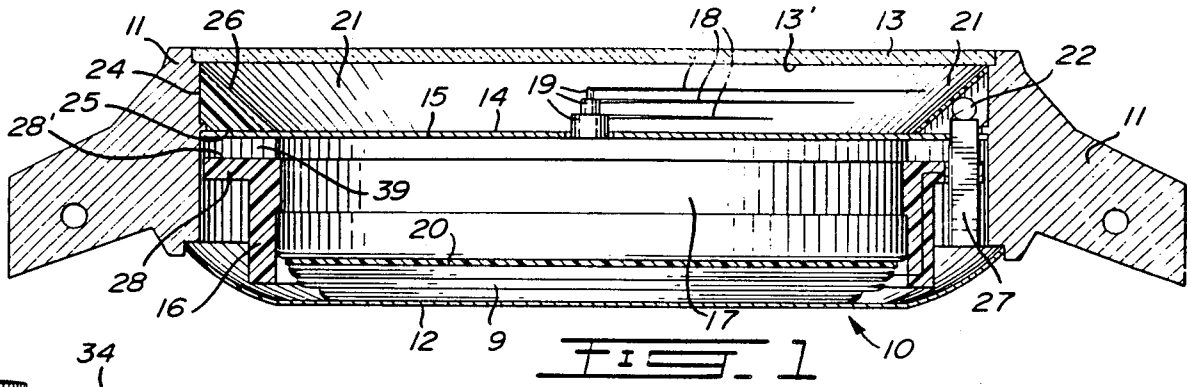
FIG. 1 is a transverse section view of the portable time piece of the present invention.
Figure 2A:
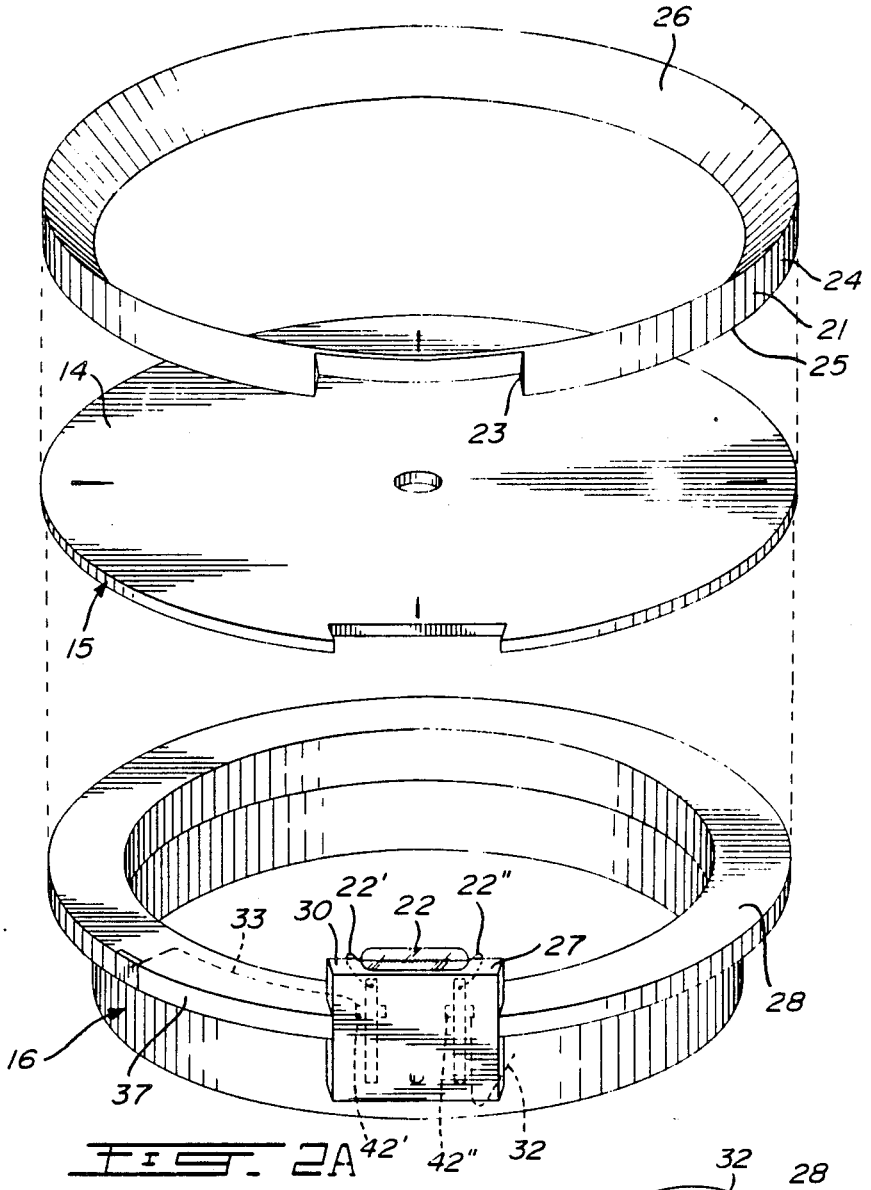
FIG. 2A is an exploded view showing the position of the light diffusing ring on the dial face and on top of the time movement support ring.
Figure 2B:
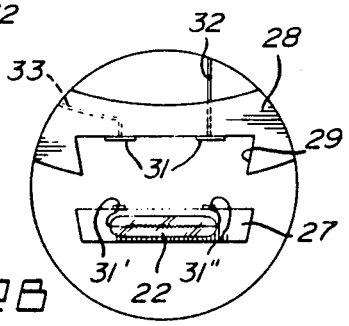
FIG. 2B is partial view showing connector for light.

Referring to the drawings, and more particularly to FIGS. 1 and 2, there is shown generally at 10 the portable time piece of the present invention and comprised of a casing 11 having a removable back cover 12 and an opposed transparent cover 13 formed of glass or plastics material through which a dial face 14 of a dial disc 15 is visible whereby to display time. A movement support ring 16 is located and secured within the casing 11 by means well known in the art and supports a time movement 17, being a mechanical gear movement or an electronic time movement. Time display needles 18 are supported on respective drive posts 19 which are connected to the time movement 17 whereby to rotate the needles in a manner well known in the art. A power cell 9 is located behind the back cover 12 and the time movement 17 and insulated therefrom by an insulating disc 20. This is preferably a very thin plastics material disc.

The novelty in the construction of the portable time piece 10 resides in that a light diffusing member, herein a light diffusing ring 21, is disposed on top of the dial disc 15 intermediate the dial face 14 and the back face 13' of the transparent cover 13. This light diffusing member may be constructed of glass or plastics material and may be translucent or may consist of colored plastics material, or have portions or the entire ring painted with light illuminescent paint. The member or ring 21 may also be formed integral with the glass 13 and extend in only a part of the circumference thereof.

A light source 22, herein a miniature light capable of generating about 5 volts of candle power light, is located within a light receiving cavity 23 disposed within the light diffusing ring 21 whereby to generate light therein.

As can be seen, the light diffusing ring is of substantially triangular cross-section and has two right-angled walls 24 and 25 and an intermediate sloped wall 26. The sloped wall 26 faces inwardly of the dial ring 15 and is angulated outwards of the dial face, and as herein shown at 45 degrees, whereby to direct light rays outwards of the dial face through the transparent cover 13 whereby the wristwatch also acts as a miniature flashlight, which we refer to as a "flashwatch". This is an important feature of the construction of the ring so that the watch can illuminate objects exteriorly thereof, such as a key of car door, etc..

A light support block 27 is removable secured in tight sliding fit with a flange wall 28 provided at a top end of the movement support ring 16. The support block has a wedge configuration which is receivable within a wedge cavity 29 formed in the outer peripheral edge of the flange wall 28. The light source 22 is mounted on a top wall 30 of the light support block 27 and has its terminal ends 22' and 22" connected to respective ones of a pair of electrical strip contacts 31' and 31" secured to the block 27. These electrical contacts 31' and 31" are associated with fixed contacts 42' and 42" respectively. A positive (+) wire 32, which engages the positive side of the battery is connected to fixed contact 42", and a switch contact wire 33, which will be described later, is connected to fixed contact 42'. Accordingly, when the support block 27 is placed in its proper position on the flange wall 28 of the support ring 16, the contacts 31' and 31" will connect to fixed contacts 42' and 42" and establish continuity with the wires 32 and 33. The sliding block construction pencils for the lamp 22 to be replaced by simply removing the back cover 12 and sliding out the block 27 containing the lamp. Therefore, the replacement can be effected quickly without having to dismantle the watch. This is also an important feature of the invention.

Figure 4:
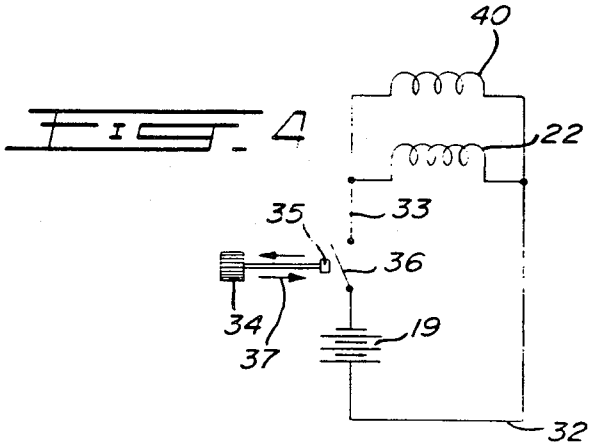
FIG. 4 is a circuit diagram showing the connection of the power cell to two light sources.
Figure 3:
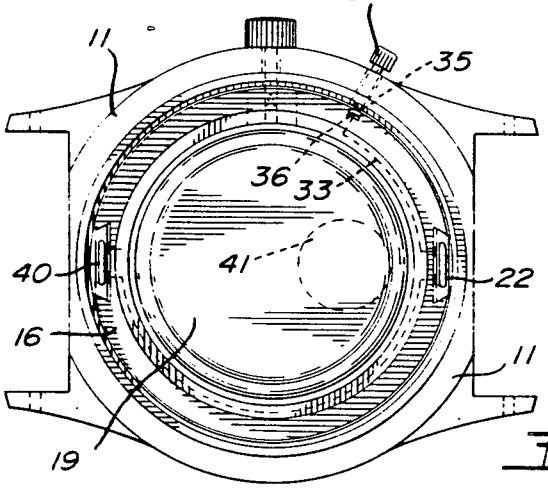
FIG. 3 is a partly sectioned rear view of the wristwatch showing modifications thereto.

Referring now to FIGS. 3 and 4, it can be seen that a switch element, herein a push-button switch 34 is secured to the casing 11 and has a contact engaging end 35 which is aligned with an open contact switch element 36 provided on the outside surface 37 of the flange wall 28. When the push-button contact 36 is pushed inwardly of the casing in the direction of arrow 37, the displaceable contact 36 closes and connects the switch contact wire 33 to one side of the power cell 19. The other side of the power cell is connected to the wire 32 and thus a closed circuit condition is established with the light source 22.

As shown in FIG. 3, there may be provide an additional light source 40 secured in a similar fashion as previously described with reference to light source 22 but located at a remote location on the movement support ring 16 with the end terminals thereof connected in parallel with the other light source 22, as shown in FIG. 4. Thus, when a switch closure occurs both light sources will illuminate. It is also pointed out that the push-button type switch is provided with suitable spring means (not shown) to bias the element in a non-switch-activating position. Alternatively, the contact element 36 could be spring-biased to achieve the same results. It is also conceived that a push-button switch could be associated with each of the lamps 22 and 40.

It is also pointed out that the second light source 40 could be associated with a date calendar display opening provided in the dial disc 15 with the second light source 40 located under the dial disc in close proximity to the opening. Thus, the light source would be positioned intermediate the dial disc 15 and the top face 28' of the support ring 16, such as in the area 39 as shown in FIG. 1.

As also shown in FIG. 3, there may be provided two power cells with the time movement 17 being driven by power cell 41 and the light source(s) driven by power cell 19.

It is within the ambit of the present invention to cover any other obvious modifications of the examples of the preferred embodiment described herein, provided such modifications fall within the scope of the appended claims.

I claim:

1. A portable time piece having a casing for supporting a watch movement therein, a dial face having time indicating means located in said housing and disposed for visual access from a top side of said housing to display time, said time piece being characterized by a light diffusing ring member disposed along the circumferential edge of said dial face, at least one light source associated with said light diffusing ring member so that light is transmitted along and out of said ring member to illuminate at least a portion of said dial face, said light diffusing ring member being of substantially triangular cross-section and having two right angle walls and an intermediate wall constituting said sloped wall, said sloped wall facing inwardly and angulated outwards of said dial face to direct light rays outwards of said dial face while illuminating said dial face, and electrical circuit means to apply electrical power to said light source, said ring member being provided with a light receiving cavity, means to support said light source in said cavity, said electrical circuit means having a switch element for connecting and disconnecting said power to said light source, said means to support said light source being a light support block in tight sliding fit with an existing element of said time piece, said support block having electrical contacts connected to terminals of said light source and engageable with battery contacts associated with said existing element when said support block is disposed in sliding fit therewith.

2. A time piece as claimed in claim 1 wherein said light diffusing ring is held over said circumferential edge of said dial face by a transparent disc cover disposed and spaced above said dial face in close proximity to a top edge of said diffuser ring.

3. A time piece as claimed in claim 1 wherein said support block is a support ring for supporting said watch movement within said casing.

4. A time piece as claimed in claim 1 wherein said switch element is a push-button type switch secured to said casing, said push-button having a contact engaging end for closing an open contact in a connecting wire connected to a terminal of said battery and a terminal of said light source.

5. A time piece as claimed in claim 4 wherein there are two of said light sources disposed in respective ones of said two light receiving cavities, said light sources being connected in parallel with one another.

6. A time piece as claimed in claim 4 wherein there is provided a further light source disposed under said dial face and associated with a calendar mechanism to illuminate a display date visible on said dial face.

7. A time piece as claimed in claim 4 wherein there are two batteries in said casing, one of said batteries being connected to drive said movement, the other battery being connected to said push-button switch to supply said light source.

8. A time piece as claimed in claim 1 wherein said dial face is a flat disc, said disc having a notch in a peripheral area thereof for the passage of said light support block.

9. A time piece as claimed in claim 1 wherein said diffuser ring is provided with position indicating means to identify specific time locations about said dial face.

10. A time piece as claimed in claim 1 wherein said diffuser ring is a colored ring having a light reflecting pigmentation.

11. A time piece as claimed in claim 1 wherein said diffuser ring is made of plastics material.

12. A time piece as claimed in claim 4 wherein said open contact is disposed on an outside wall of said support ring and has a displaceable electrically conductive contact, said support ring being disposed in said casing with said conductive contact located in alignment with said contact engaging end of said push-button switch.

* * * * *